US006092651A

United States Patent [19]

Miller

[11] Patent Number: 6,092,651

[45] Date of Patent: Jul. 25, 2000

[54] WRAP AROUND HINGED END CAP FOR PACKAGING A COMPUTER SYSTEM

[75] Inventor: Michael Thomas Miller, Austin, Tex.

[73] Assignee: Dell USA, L. P., Roundrock, Tex.

[21] Appl. No.: 09/245,144

[22] Filed: Feb. 4, 1999

[51] Int. Cl.[7] ..... B65D 81/107

[52] U.S. Cl. ..... 206/305; 206/320; 206/521; 206/523; 206/586; 493/355

[58] Field of Search ..... 206/305, 320, 206/523, 586, 594, 521; 493/355

[56] References Cited

U.S. PATENT DOCUMENTS

| | | | |
|---|---|---|---|
| 3,854,650 | 12/1974 | Hanaue | 206/523 |
| 3,938,661 | 2/1976 | Carmody . | |
| 3,994,433 | 11/1976 | Jenkins et al. . | |
| 4,122,946 | 10/1978 | Holley . | |
| 4,413,735 | 11/1983 | Little | 206/523 |
| 4,709,817 | 12/1987 | Keady et al. . | |
| 4,840,277 | 6/1989 | Waldner | 206/523 |
| 4,972,954 | 11/1990 | Dickie . | |
| 5,060,801 | 10/1991 | Vilas-Boas | 206/523 |
| 5,090,571 | 2/1992 | Walker | 206/523 |
| 5,207,327 | 5/1993 | Brondos | 206/523 |
| 5,215,195 | 6/1993 | Williams . | |
| 5,876,813 | 3/1999 | Bambara et al. . | |

*Primary Examiner*—Jim Foster
*Attorney, Agent, or Firm*—Haynes and Boone, LLP

[57] ABSTRACT

A sheet of material having a first layer of a first density is patterned to include a main body having a plurality of sides and a side member pivotably attached to the main body adjacent at least one side thereof. At least one relief is formed in the main body for decoupling a portion of the main body from the respective side member. The reliefs permit the side member to move relative to the decoupled portion of the main body in a direction generally perpendicular to the respective side of the main body. The sheet of material may further include a second layer of a second density, different than the first density. The second layer is patterned to form a hinge between the main body and each respective side member to enable each side member to be pivotable relative to the main body.

24 Claims, 4 Drawing Sheets

WRAP AROUND HINGED END CAP FOR PACKAGING A COMPUTER SYSTEM

BACKGROUND

The disclosures herein relate generally to computer system packaging devices. More particularly, the disclosure herein relates to computer system packaging devices made from a single type of material and having a plurality of hinged sections.

Strict environmental legislation in various global markets has caused many companies to change their packaging methods and materials. For the past few years, many manufacturers have been receiving pressure in Europe to make their packaging more environmentally friendly (i.e. economically recyclable). For some of these manufacturers, it has not been economically feasible to make an immediate change from their existing packaging techniques due to considerations such as the cost of packaging materials, production throughput, and compatibility of new materials with their existing manufacturing equipment and processes. For these manufacturers to be in a position to make a change to more environmentally friendly packaging, the new packaging techniques must meet product protection, product cost, and manufacturing productivity requirements.

A common problem that precludes packaging materials from being recyclable is when two or more different materials are bonded to form a packaging device or container. For example, some packaging devices have pieces of polyethylene foam bonded to corrugated paper. By bonding these two materials together, the packaging device becomes more difficult and expensive to recycle. The cost associated with separating the materials can be prohibitive. Furthermore, there exists the potential for contamination of one recycled material by the other material if they are not properly and completely separated.

When packaging computer devices such as a central processing unit (hereinafter referred to as CPU), manufacturers cannot compromise the protection of the CPU. Typically, a CPU is shipped in corrugated paper boxes having a packaging device that protects the CPU from damage due to impact. In some instances, the packaging device is of a construction as described above wherein pieces of polyethylene foam are bonded to corrugated paper. In other instances, the packaging device is a molded foam insert commonly known as "end caps". Regardless of the specific type of packaging device used, the packaging device for computer devices such as CPU's must exhibit excellent impact absorption characteristics. These characteristics are afforded by the materials selected for the packaging device as well as its design.

For top loading of an item such as a CPU, some packaging devices such as end caps have been found to constrain the rate at which these items can be loaded. It has further been found that loading the end caps into the box and then loading the CPU improves the efficiency of the packaging operation and enables compatibility with specialized, high-speed top loading equipment. It is important that the end cap allow the CPU to be loaded from the top, but it must also provide impact protection on all sides during shipping and handling.

To provide further benefit, it is preferable to have an end cap that is of a one-piece construction. This allows the end caps to be shipped from the supplier flat to reduce shipping expenses and warehouse space. Tailoring the resiliency of specific regions of the material is also desirable. This enables the ability of the device to absorb impact to be tuned for different regions of the item packaged and for different types of impact loadings.

U.S. Pat. No. 4,709,817 to Keady discloses a shock protective device for use with a carton for shipping shock sensitive products. The device includes a foldable padded insert which fits inside the carton. The insert folds over and surrounds the product to be shipped with a first group of interior blocks of shock absorbing material attached to one face thereof. A second group of exterior blocks of shock absorbing material are attached to the opposite face of the insert which hold the insert in place within the carton. The exterior blocks are vertically aligned with the interior blocks when the insert is folded over a product to be shipped to preclude squashing of a device in the carton during shipment. The exterior blocks absorb shock transmitted to the carton and the interior blocks absorb any shock transmitted to the insert within the carton.

U.S. Pat. No. 3,994,433 to Jenkins et al discloses a one-piece corner pad for use in packaging fragile articles. The corner pad is formed from a single, flat piece of thick yieldable, shock-absorbing synthetic cushioning material which can be shipped and stored in flat form. The pad has an integral tab and slot locking arrangement to provide means for holding the corner pad in a three-sided configuration without using any adhesives, tapes, clips or other fasteners.

U.S. Pat. No. 4,122,946 to Holley discloses a shipping pad that has three dimensional shock resistance characteristics. The component parts of the shipping pad may be fabricated from a single sheet of plastic foam material, thus facilitating storage of the unit prior to assembly. After the component parts are removed from the sheet of foam material, they may be assembled into a shipping pad configuration with interlocking cross bars. No adhesive or other fastening means foreign to the foam material need be used.

U.S. Pat. No. 4,972,954 to Dickie discloses a product supporting packaging insert fabricated from a substantially rectangular flat blank of material such as polypropylene foam, corrugated cardboard, or honey-comb cardboard. The flat blank is die cut to form a lateral end segment at one end of the blank, a pair of longitudinal parallel side segments adjoining the lateral end segment and a longitudinal central segment adjoining the lateral end segment. The central segment is provided with a tab receptacle at its end facing the end segment. The end segment is provided with a tab facing the end of the blank. Fold lines allow the various segments to be folded into place, producing a one-piece insert.

U.S. Pat. No. 5,207,327 to Brondos discloses a one-piece packaging cushion formed from a single piece of pliable padding material. The sheet of material includes a collection of members formed by cutting at least partway through the sheet of material. An aperture for receiving and snugly holding an item is formed by cutting the material such that two members can be rotated, thereby establishing the orifice.

Accordingly, a need has arisen for a computer system packaging device that overcomes the shortcomings of previous techniques. More particularly, a need has arisen for a cost-effective computer system packaging device that can be economically and conveniently recycled, particularly for packaging CPU's and other computer system devices. Furthermore, it is a key advantage that the packaging device not result in the need for significant changes to existing manufacturing equipment and processes.

SUMMARY

One embodiment, accordingly, provides a computer system packaging device that can be economically recycled, that can be shipped flat and that will permit cost-effective effective top loading of items such as CPU's with specialized and conventional packaging equipment. The computer system packaging device will also manage how loads applied to one portion of the device are transmitted to another portion of the device. To this end, a computer system packaging device includes a sheet of material having a first layer of a first density. The sheet of material is patterned to include a main body having a plurality of sides and a side member pivotably attached to the main body adjacent at least one side thereof. At least one relief is formed in the main body for decoupling a portion of the main body from the respective side member thereby permitting the side member to move relative to the decoupled portion of the main body in a direction generally perpendicular to the respective side of the main body.

A principal advantage of this embodiment is that the computer system packaging device can be recycled without having to separate materials. This will make the computer system packaging device more attractive as a global packaging solution, particularly in global markets where strict recycling programs are in place. A further advantage is that the computer system packaging device is less expensive to ship and store because it can be provided in a flat format. Due in part to logistics issues, yet another advantage is that the computer system packaging device and the item it protects can be loaded into a container more cost effectively than a multiple piece packaging device. A still further advantage is that the reliefs in the main body afford the computer system packaging device with the ability to custom-tailor the impact characteristics of various portions of the computer system packaging device.

BRIEF DESCRIPTION OF THE DRAWING FIGURES

DETAILED DESCRIPTION

Figure 1:
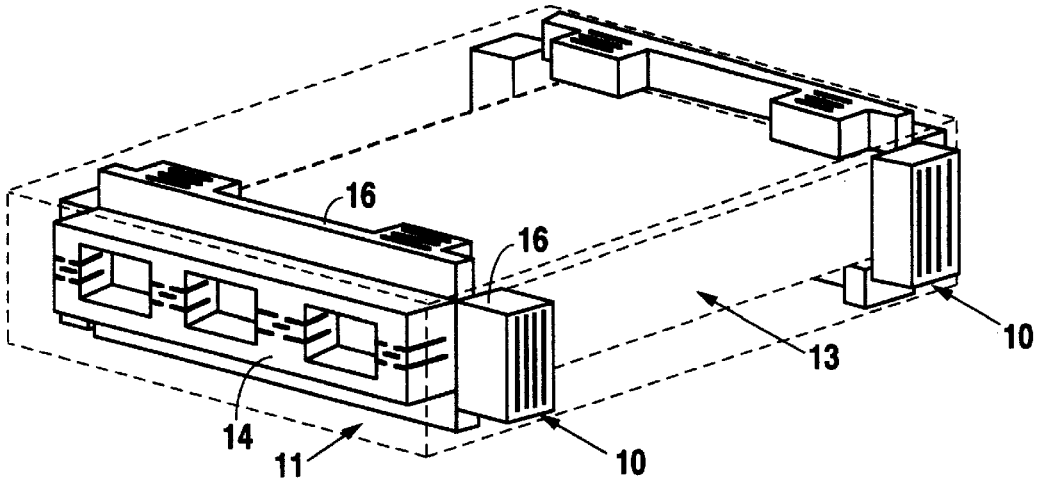
FIG. 1 is a perspective view showing an illustrative embodiment of a pair of computer system packaging devices.
Figure 2A:
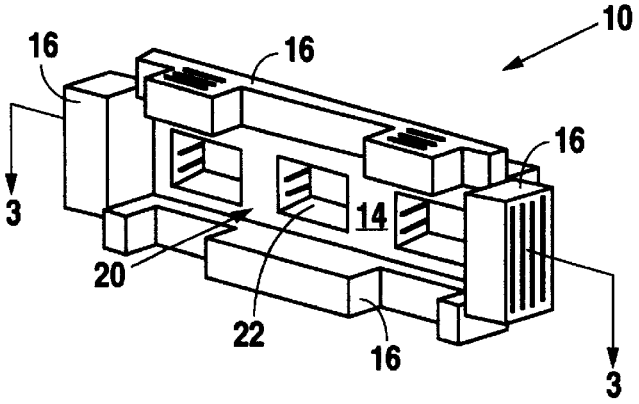
FIG. 2A is a perspective view showing a cavity formed by a computer system packaging device according to the illustrative embodiment of FIG. 1.
Figure 2B:
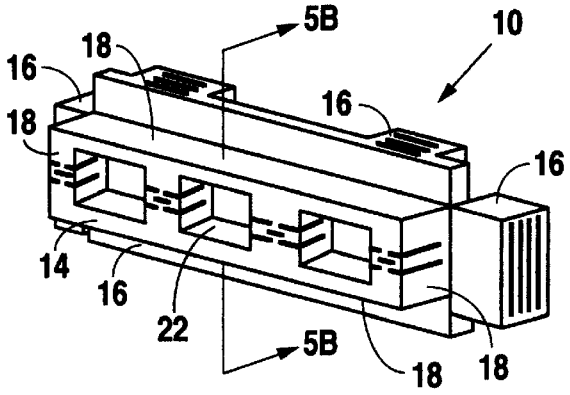
FIG. 2B is a perspective view showing the exterior features of a computer system packaging device according to the illustrative embodiment of FIG. 2A.

In one embodiment, FIGS. 1 and 2, two computer system packaging devices, each indicated generally at 10, are shown receiving an impact sensitive article 13 such as a CPU, VIDEO DISPLAY, or other component of a computer system in a container 11 such as a corrugated box. The computer system packaging device 10 includes a generally rectangular main body 14 with a side member 16 attached adjacent to each of its sides 18. Each side member 16 is attached the main body 14 in a fashion allowing them to be pivotable relative to the main body 14 thereby forming a cavity 20 for receiving the impact sensitive article 13. The main body 14 may include openings 22 for reducing the weight of the computer system packaging device 10 or for receiving a protruding portion (not shown) of the impact sensitive article 13.

Figure 3:
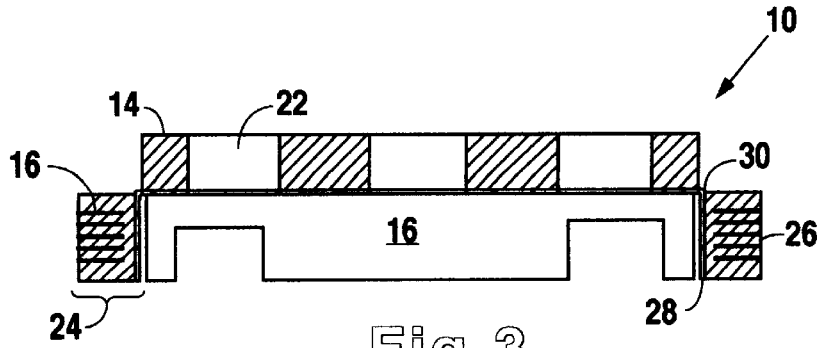
FIG. 3 is a cross-sectional view taken at line 3—3 in FIG. 1.
Figure 4:
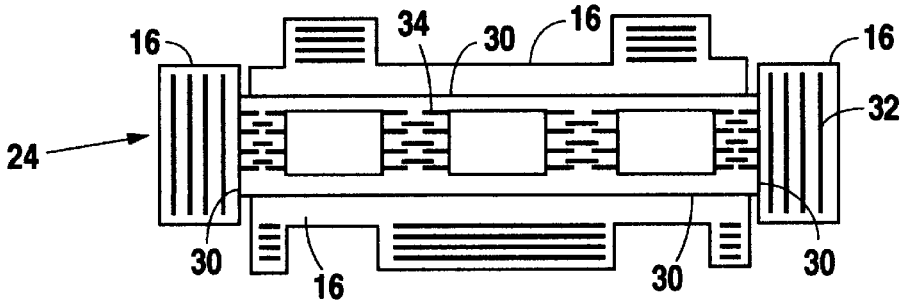
FIG. 4 is a plan view of a die cut computer system packaging device according to the illustrative embodiment of FIG. 1.

As shown in FIGS. 3 and 4, the computer system packaging device 10 may be made from a sheet of material 24 having a first layer 26 and a second layer 28. The first layer 26 and second layer 28 may be different density materials (i.e. a high density foam and a low density foam), different material formats (i.e. foam and film), different material types (i.e. polyethylene and olefin-based elastomer) or other combinations of materials offering beneficial properties. The sheet of material 24 may be formed to utilize the second layer 28 as a hinge 30 to permit the side members 16 to be pivotable relative to the main body 14. In this instance, it would be preferable for the second layer 28 to be made of a material that exhibits sufficient resiliency to function as a hinge 30 for an appropriate number of hinge flex cycles.

The sheet of material 24 may be patterned as shown in FIG. 4 using techniques such as die cutting, laser cutting, embossing, or other suitable patterning techniques. The sheet of material 24 may be formed to include one or more side members 16 attached to the main body 14. The sheet of material is preferably a flat multi-layer foam substrate such as that sold by Sealed Air Corporation under the tradename STRATOCELL PLUS. This multi-layer foam substrate has a first layer of low density polyethylene foam approximately 2.00" thick and a second layer of high density polyethylene foam approximately 0.125" thick. The second layer of this substrate is suitable for the hinge requirement and the substrate is easily-processed using commercially available techniques such as steel rule dies. Typically, the first layer 26 will be cut down to the interface between the first layer 26 and the second layer 28 at the locations where a hinge 30 is to be formed. At the locations were reliefs 32, 34 are formed, the material may be cut entirely through the sheet of material 24.

Figure 5A:
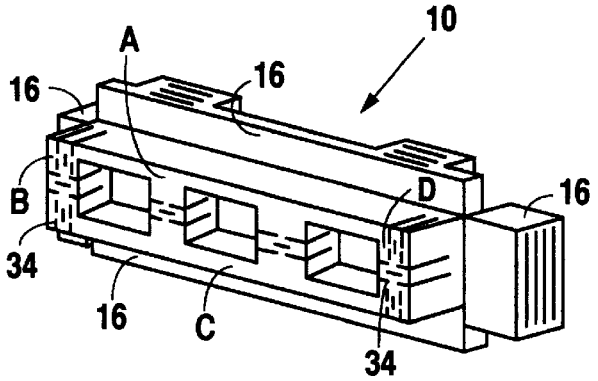
FIG. 5A is a fragmentary, perspective view showing decoupled portions of the computer system packaging device.
Figure 5B:
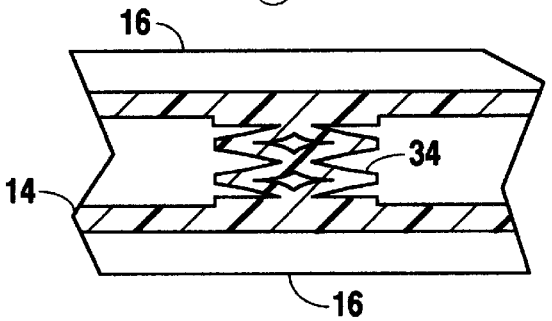
FIG. 5B is a fragmentary, cross-sectional view taken at line 4—4 in FIG. 2B showing an expanded pleated-type relief.

Referring to FIGS. 4–6, a number of regions of the computer system packaging device 10 are patterned to include straight cut reliefs 32 and pleated reliefs 34. The pleated reliefs 34 serve to decouple movement of the side members 16 from the main body 14. The pleated reliefs 34 are orientated parallel to each respective hinge 30 to allow the respective side member 16 to move in a direction perpendicular to the axis of the hinge 30. In operation, this is important as it improves the impact damping characteristics of the computer system packaging device 10. As illustrated in FIGS. 5A and 5B, by decoupling the side members 16 from the main body 14 through the expansion of the pleated reliefs 34, external loads imparted on one side member 16 are not fully transmitted to an adjacent side member 16 or to the decoupled portion of the main body 14. By dampening the external loads from one region of the computer system packaging device 10 to another region, improved impact resistance is achieved.

As shown in FIGS. 5A and 5B, the reliefs 34 are formed in the main body 14 to define portions A–D of the main body 14 and permit movement of these portions with a respective side member 16. Portions A–D are decoupled from each other by pleated reliefs 34 such that they can move with the respective side member 16 when the side member 16 is subjected to an impact loading. It is contemplated that reliefs having other profiles will also be suitable for decoupling portions of the main body 14.

Figure 6A:
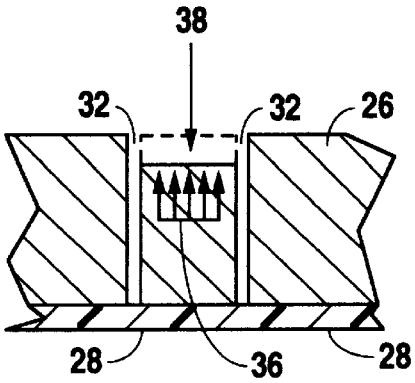
FIG. 6A is a conceptual illustration showing the forces associated with a relieved portion of the computer system packaging device.
Figure 6B:
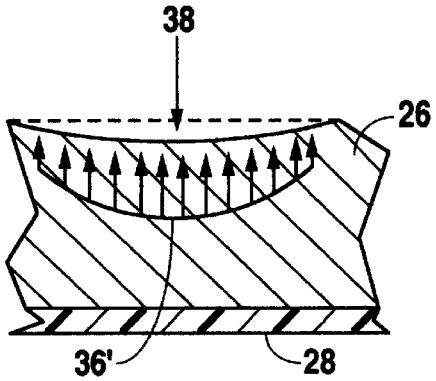
FIG. 6B is a conceptual illustration showing the forces associated with a non-relieved portion of the computer system packaging device.

For a sheet of material 24 with straight cut reliefs 32, as best seen in FIGS. 6A and 6B, the straight cut reliefs 32 serve to provide a reactive force 36 in response to a given load 38. When a load 38' is applied on a region of the sheet of material 24 that does not have straight cut slits 32, the material adjacent to where the load 38' is applied is acted on to develop internal forces resulting in a reactive force 36 than is greater than the reactive force 36. However, by decoupling the adjacent material, the reactive force 36 of the sheet of material 24 with straight cut slits 32 precludes the internal forces from being generated such that a reduced reactive force 36 is produced. This allows the impact absorption characteristics of various portions of the packaging device to be individually modified.

Figure 7:
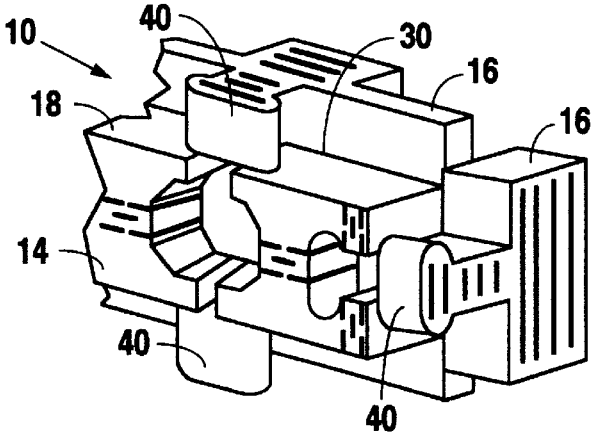
FIG. 7 is a fragmentary perspective view showing an alternate illustrative embodiment of a computer system packaging device with locking tabs.

Referring now to FIG. 7, the computer system packaging device 10 may be patterned to further include locking tabs 40. The locking tabs 40 serve to hold a respective side member 16 in the pivoted position. This feature aids in pivoting the side members 16 into their rotated orientation and then placing the computer system packaging device 10 into a container 11 (FIG. 1) such as a box at a later point in time.

Figure 8A:
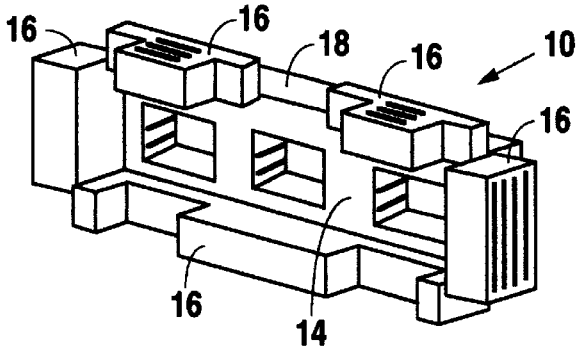
FIG. 8A is a perspective view showing an alternate illustrative embodiment of a computer system packaging device with two side members on a side of the main body.
Figure 8B:
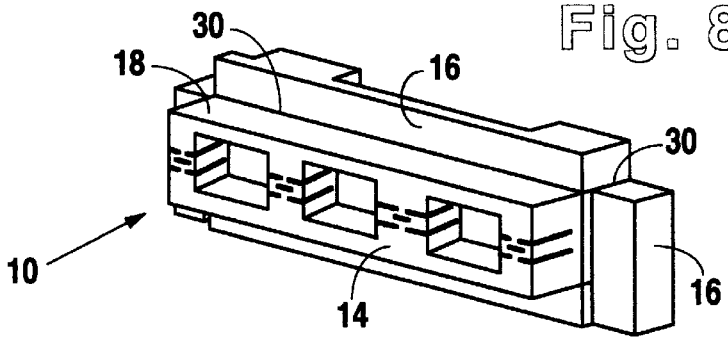
FIG. 8B is a perspective view showing an alternate illustrative embodiment of a computer system packaging device with an alternate side member attachment configuration.

In FIGS. 8A and 8B, alternate embodiments of the side members 16 are shown. In FIG. 8A, a side 18 of the main body 14 is shown to have two side members 16 attached thereto. This may be desirable in a situation where two separate items are packaged together, but at different times. In this fashion, the side members 16 may be separately engaged. In FIG. 8B, the side member 16 for one side of the main body 14 is shown to be attached by a hinge 30 to another side member 16. In this fashion, a side member 16 for each side 18 of the main body 14 is provided, but only two of the side members 16 are attached directly to the main body 14.

Figure 9A:
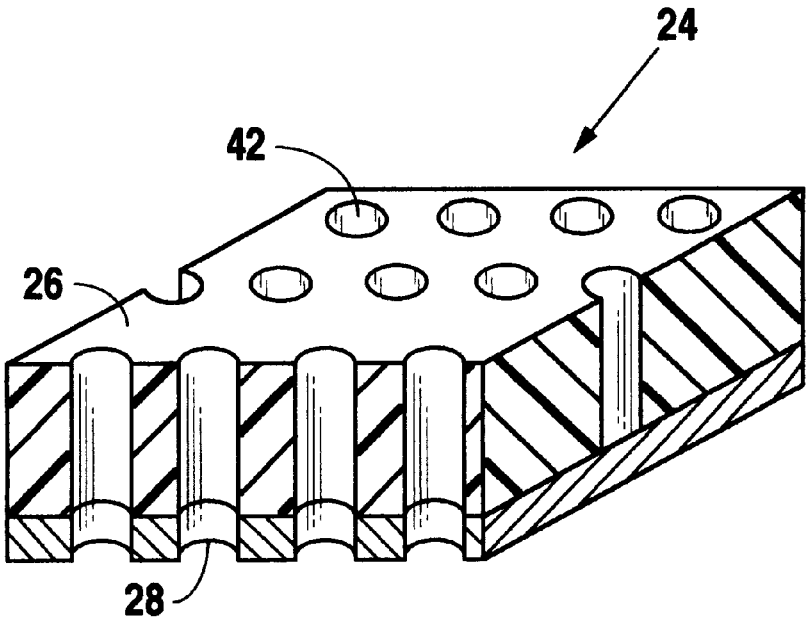
FIGS. 9A and 9B are fragmentary perspective views showing alternate configurations for the reliefs.
Figure 9B:
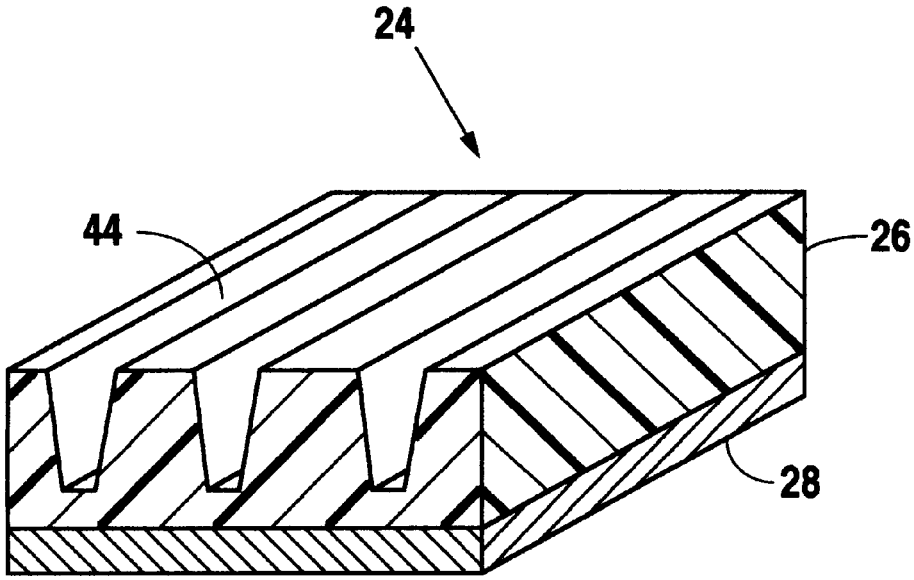

FIGS. 9A and 9B show alternate relief configurations. A plug-shaped relief 42 is shown in FIG. 9A and a channel-shaped relief 44 is shown in FIG. 9B. As will become apparent to one skilled in the art, a variety of alternate relief profiles will be contemplated. The key requirement in selecting a profile for the reliefs is the effect on decoupling one region material from another.

In operation, when a load is applied to a computer system packaging device according to the illustrative embodiments presented herein, the loads are damped in two fashions. In the first fashion, a load applied to one portion (i.e. a side member 16) of the computer system packaging device is at least partially damped by the decoupling effect of the reliefs formed in the main body. In the second fashion, the load applied on a side member may be damped more effectively by tailoring the resiliency of the side member with one or more reliefs (i.e. straight cut reliefs) formed therein. Also, in operation, the side members are attached to the main body by hinges to permit the computer system packaging device to be formed from a flat sheet of material. The side members may be rotated into a desired position to facilitate packaging and protecting an impact sensitive article such as a CPU.

As a result, one embodiment provides a computer system packaging device including a sheet of material having a first layer of a first density. The sheet of material is patterned to include a main body having a plurality of sides and a side member pivotably attached to the main body adjacent at least one side thereof. At least one relief is formed in the main body for decoupling a portion of the main body from the respective side member thereby permitting the side member to move relative to the decoupled portion of the main body in a direction generally perpendicular to the respective side of the main body.

In another embodiment, a computer system packaging device includes a sheet of material having a first layer of a first density. The sheet of material is patterned to include a main body having a plurality of sides and a side member pivotably attached to the main body adjacent at least one side thereof. The main body includes features adapted to decouple a portion of the main body from the respective side member thereby permitting the side member to move relative to the decoupled portion of the main body in a direction generally perpendicular to the respective side of the main body. The features adapted to decouple the portion of the main body are formed in the main body.

In still another embodiment, a protective package includes a container and two computer system packaging devices within the container having an impact sensitive article received between the computer system packaging devices. The computer system packaging devices include a sheet of material having a first layer of a first density. The sheet of material is patterned to include a main body having a plurality of sides and a side member pivotably attached to the main body adjacent at least one side thereof. At least one relief is formed in the main body for decoupling a portion of the main body from the respective side member thereby permitting the side member to move relative to the decoupled portion of the main body in a direction generally perpendicular to the respective side of the main body.

In still a further embodiment, a method for making a computer system packaging device includes the steps of providing a sheet of material having a first layer of a first density; patterning the sheet of material to include a main body having a plurality of sides and a side member pivotably attached to the main body adjacent at least one side thereof; and forming at least one relief in the main body for decoupling a portion of the main body from the respective side member thereby permitting the side member to move relative to the decoupled portion of the main body in a direction generally perpendicular to the respective side of the main body.

As it can be seen, a principal advantage of these embodiments is that the computer system packaging device can be recycled without having to separate materials. This will make the computer system packaging device more attractive as a global packaging solution, particularly in global markets where strict recycling programs are in place. A further advantage is that the computer system packaging device is less expensive to ship and store because it can be provided in a flat format. Due in part to logistics issues, yet another advantage is that the computer system packaging device and the item it protects can be loaded into a container more cost effectively than a multiple piece packaging device. A still further advantage is that the reliefs in the main body afford the computer system packaging device with the ability to custom-tailor the impact characteristics of various portions of the computer system packaging device.

Although illustrative embodiments have been shown and described, a wide range of modification, change and substitution is contemplated in the foregoing disclosure and in some instances, some features of the embodiments may be employed without a corresponding use of other features. Accordingly, it is appropriate that the appended claims be construed broadly and in a manner consistent with the scope of the embodiments disclosed herein.

What is claimed is:

1. A computer system packaging device, comprising:

a sheet of material having a first layer of a first density patterned to include a main body having a plurality of sides and a first side member pivotally attached to the main body adjacent a first side thereof;

at least one relief formed in the main body for decoupling a portion of the main body from the first side member, thereby permitting the first side member to move in a direction generally perpendicular to the first side of the main body;

the main body having a generally rectangular profile and the plurality of sides including two pair of opposing sides, at least one pair of the opposing sides having a second side opposite the first side and a second side member pivotally attached to the main body adjacent the second side thereof; and the first and second side members each having a plurality of reliefs formed therein.

2. The computer system packaging device of claim 1 wherein the reliefs have a profile selected from the group consisting of slits, channels, holes, and pleats.

3. The computer system packaging device of claim 1 wherein the sheet of material further includes a second layer being of a second density, different than the first density.

4. The computer system packaging device of claim 3 wherein the second layer is patterned to form a hinge between the main body and each respective side member thereby enabling each side member to be pivotable relative to the main body.

5. The computer system packaging device of claim 1 wherein each of the reliefs is formed at least partially through the first layer.

6. The computer system packaging device of claim 1 further including at least one locking tab in combination with at least one of the side members.

7. The computer system packaging device of claim 1 wherein a third side includes a third side member and a fourth side, opposite the third side, includes a fourth side member.

8. The computer system packaging device of claim 7 wherein the side members are pivotable relative to the main body to form a cavity therebetween.

9. The computer system packaging device of claim 1 wherein each of the side members has at least one relief formed adjacent thereto in the main body.

10. The computer system packaging device of claim 9 wherein the first layer is made of a complaint material.

11. The computer system packaging device of claim 10 wherein the complaint material is a foam material.

12. A packaging device, comprising:

a sheet of material having at least one layer patterned to include a main body having a generally rectangular profile and a plurality of sides including a first side and a second side opposite the first side;

a first side member attached to the first side, the first side member having a plurality of reliefs formed therein;

a second side member attached to the second side, the second side member having a plurality of reliefs formed therein; and a plurality of reliefs formed in the main body for decoupling the main body from the first side member and the second side member, thereby respectively permitting the first and second side members to pivotally move in a direction generally perpendicular to the first and second sides of the main body.

13. A protective package for packaging a computer system, comprising:

a container;

two computer system packaging devices within the container having an impact sensitive article received therebetween;

the computer system packaging devices including:

a sheet of material having a first layer of a first density, and a second layer of a second density different from the first density, and patterned to include a main body having a generally rectangular profile and a plurality of sides including a first side and a second side opposite the first side;

a first side member attached to the first side, the first side member having a relief formed therein;

a second side member attached to the second side, the second side member having a relief formed therein; and a plurality of reliefs formed in the main body for decoupling the main body from the first side member and the second side member, thereby respectively permitting the first and second side members to pivotally move in a direction generally perpendicular to the first and second sides of the main body.

14. A method for making a computer system packaging device, comprising:

providing a sheet of material having a first layer of a first density;

patterning the sheet of material to include a main body having a generally rectangular profile and a plurality of sides including a first side and a second side opposite the first side;

attaching a first side member to the first side, the first side member having a relief formed therein;

attaching a second side member to the second side, the second side member having a relief formed therein; and forming a plurality of reliefs in the main body for decoupling the main body from the first side member and the second side member, thereby respectively permitting the first and second side members to pivotally move in a direction generally perpendicular to the first and second sides of the main body.

15. The method of claim 14 wherein the at least one relief is formed to have a profile selected from the group consisting of slits, channels, holes, and pleats.

16. The method of claim 14 wherein the at least one relief is formed at least partially through the first layer.

17. The method of claim 14 wherein the at least one relief is formed by a technique selected from the group consisting of drilling, slitting, punching, and die cutting.

18. The method of claim 14 wherein the sheet of material further includes a second layer having a second density attached to the first layer, the second density being greater than the first density.

19. The method of claim 14 further including the step of patterning the second layer to form a hinge between the main body and each respective side member.

20. The method of claim 14 further including the step of patterning the sheet of material to include at least one locking tab in combination with at least one of the side members.

21. A computer system packaging device, comprising:

a sheet of material having a first layer of a first density patterned to include a main body having a plurality of sides and a side member pivotally attached to the main body adjacent at least one side thereof;

at least one relief formed in the main body for decoupling a portion of the main body from the respective side member thereby permitting the side member to move relative to the decoupled portion of the main body in a direction generally perpendicular to the respective side of the main body; and wherein said side member has a plurality of reliefs formed therein.

22. The computer system packaging device of claim 21 wherein the sheet of material further includes a second layer being of a second density, different than the first density.

23. The computer system packaging device of claim 22 wherein the second density is greater than the first density.

24. The computer system packaging device of claim 22 wherein the second layer is patterned to form a hinge between the main body and each respective side member thereby enabling each side member to be pivotable relative to the main body.

* * * * *